US010258527B2

(12) United States Patent
Rodriguez

(10) Patent No.: US 10,258,527 B2
(45) Date of Patent: Apr. 16, 2019

(54) LATTICED PATIENT HOISTING DEVICE FOR HOSPITAL BED

(71) Applicant: Taina Rodriguez, West New York, NJ (US)

(72) Inventor: Taina Rodriguez, West New York, NJ (US)

( * ) Notice: Subject to any disclaimer, the term of this patent is extended or adjusted under 35 U.S.C. 154(b) by 198 days.

(21) Appl. No.: 14/830,259

(22) Filed: Aug. 19, 2015

(65) Prior Publication Data

US 2016/0338894 A1 Nov. 24, 2016

Related U.S. Application Data

(60) Provisional application No. 62/165,415, filed on May 22, 2015.

(51) Int. Cl.

| | |
|---|---|
| ***A61G 7/10*** | (2006.01) |
| ***A61G 15/00*** | (2006.01) |
| ***A61G 1/013*** | (2006.01) |
| ***A61G 1/00*** | (2006.01) |
| ***A61G 1/044*** | (2006.01) |
| *A61G 7/05* | (2006.01) |

(52) U.S. Cl.

CPC ..... *A61G 7/1023* (2013.01); *A61G 7/1063* (2013.01); *A61G 1/013* (2013.01); *A61G 1/044* (2013.01); *A61G 7/052* (2016.11); *A61G 7/0507* (2013.01)

(58) Field of Classification Search

CPC .. A61G 7/1023; A61G 7/1049; A61G 7/1051; A61G 7/1053; A61G 7/052; A61G 7/0507; A61G 7/1063; A61G 7/10; A61G 15/00; A61G 1/00; A61G 1/013; A61G 1/044; A01K 27/002

USPC ..... 119/725

See application file for complete search history.

(56) References Cited

U.S. PATENT DOCUMENTS

| | | | | |
|---|---|---|---|---|
| 2,703,412 A * | 3/1955 | Stone | A61G 7/0504 | 5/191 |
| 3,383,717 A | 5/1968 | Underwood | | |
| 3,458,878 A * | 8/1969 | Combs | A61G 7/1023 | 128/876 |
| 3,884,225 A * | 5/1975 | Witter | A61G 7/065 | 128/876 |
| 3,889,668 A * | 6/1975 | Ochs | A61F 5/05883 | 128/870 |

(Continued)

*Primary Examiner* — Nicholas F Polito
*Assistant Examiner* — Rahib T Zaman
(74) *Attorney, Agent, or Firm* — Michael J. Feigin, Esq.; Feigin and Fridman LLC

(57) ABSTRACT

A latticed patient-hoisting device for a hospital bed and methods of its use for lifting, moving, turning and positioning of hospital patients. Embodiments of the device have a plurality of vertical and parallel straps running parallel to the patient's body from head to feet and a plurality of horizontal straps perpendicular to the vertical straps. The ends of the horizontal straps are removably attached to one or more rails of a hospital bed by a loop. The device is placed under a patient, and the patient is moved by drawing one or more ends of one side of the horizontal straps and attaching those ends to one or more rails on the same side of the bed. In embodiments, one or more horizontal straps may be detached from a rail or repositioned along it to provide access to a particular area of the patient's body for patient care.

18 Claims, 9 Drawing Sheets

(56) References Cited

U.S. PATENT DOCUMENTS

D251,388 S * 3/1979 Burns ..... D24/190
4,180,879 A * 1/1980 Mann ..... A61F 5/3784 128/872
4,507,814 A * 4/1985 Zyki, Jr. ..... A61G 7/1009 5/81.1 T
4,530,122 A * 7/1985 Sanders ..... A61G 5/10 5/81.1 R
4,841,961 A * 6/1989 Burlage ..... A61F 5/3776 128/876
4,908,889 A * 3/1990 Lonardo ..... A61G 7/1023 5/81.1 T
5,083,574 A * 1/1992 Schlutow ..... A61F 5/05883 128/846
5,263,495 A * 11/1993 Butterfield ..... A61G 7/1023 128/875
5,524,304 A 6/1996 Shutes
5,920,929 A * 7/1999 Hensley ..... A61G 7/1023 5/485
5,941,434 A * 8/1999 Green ..... A45F 5/02 224/195
D417,753 S * 12/1999 Wiley ..... D29/101.1
6,073,279 A * 6/2000 Skaler ..... A61G 7/001 5/81.1 R
6,276,006 B1 * 8/2001 Hoit ..... A61G 7/1023 5/81.1 R
6,560,793 B2 * 5/2003 Walker ..... A61G 7/001 5/81.1 T
D481,579 S * 11/2003 Colbert ..... D6/607
6,851,145 B2 * 2/2005 Smith ..... A61G 1/01 5/625
7,222,378 B2 * 5/2007 DuPree ..... A61G 1/01 5/625
8,065,765 B2 * 11/2011 Rincon ..... A61G 1/01 5/625
8,281,430 B1 * 10/2012 Hough ..... A61G 7/1023 5/625
2008/0184488 A1 * 8/2008 Fee ..... A61G 1/01 5/628
2008/0235870 A1 * 10/2008 Heide ..... A47G 9/04 5/484
2009/0183309 A1 * 7/2009 Stinson ..... A61G 7/001 5/81.1 T

* cited by examiner

LATTICED PATIENT HOISTING DEVICE FOR HOSPITAL BED

FIELD OF THE DISCLOSED TECHNOLOGY

The disclosed technology relates generally to devices for patient care, and, more specifically, to a device to maneuver a patient in a hospital bed.

BACKGROUND OF THE DISCLOSED TECHNOLOGY

Maneuvering hospital patients in bed, especially those who are paralyzed, immobile, or obese, presents a challenge to caregivers. A patient's inability to move or turn in bed impedes the patient's care. For instance, hospital staff may have difficulty in accessing areas of the patient's body where it is necessary to administer treatment or tests, conduct inspections, or perform hygienic tasks. As a result, several hospital staff members are frequently required to physically lift, turn, or move the bedridden patient, to a certain position and hold the patient stable in that posture, so that the required action may be completed. Hospital staff are often over-worked and have numerous urgent tasks to handle within a limited period of time. Therefore, the diversion of personnel to assist in maneuvering a patient in bed for routine care is a wasteful and inefficient use of limited and valuable hospital resources.

Other patient-maneuvering devices are available in the market. For instance, Walker U.S. Pat. No. 6,560,793, discloses a device in which the patient is laid on a sheet with side sleeves through which poles are inserted. The sleeves contain a portal through which the pole can be grasped for one-handed movement of a patent. Two detachable lateral straps are connected to the sheet. The ends of the straps have connectors that enable the straps to be attached to a bed rail. Once a patient is moved to the desired position, the sheet can be detached from the straps and patient care rendered while the straps hold the patient in position. Walker relies on two straps and a sheet which covers the patient's body. This prevents patient care to those areas. Thus, if the patient has a wound, surgical incision, burn, catheter tube or other medical device in a particular area of his or her torso, the sheet contacts that area; this may cause pain, further injury, or dislodgement of the medical device. These issues preclude the use of the Walker invention in many cases.

What is needed in the art is a way for the medical staff to safely and securely maneuver and position a patient in bed with minimum exertion. What is further needed is a way to turn a patient while allowing extensive access to the patient's body for the rendering of care. This should ideally be accomplished without negatively affecting a patient's wounds, surgical incisions, and/or attached medical devices.

SUMMARY OF THE DISCLOSED TECHNOLOGY

The device and methods of the disclosed technology meet the needs existing in the prior art, as the device enables a caregiver to safely and securely lift, turn, or move a patient in a hospital bed, so as to facilitate patient care, as described herein. Further, the disclosed device allows the straps to be strategically engaged or positioned, so as to avoid applying pressure on sensitive areas of the patient's body that could cause further injury or interference with applied medical devices. Embodiments of the disclosed technology can include at least two vertical, spaced-apart, and parallel straps and at least three horizontal and spaced-apart straps substantially perpendicular to the vertical straps. "Parallel" in this specification is defined as sides or edges of two objects that have a uniform distance between them. In other words, if the sides or edges of the two objects were extended indefinitely, the resulting lines would never meet. "Perpendicular," in this specification, is defined as oriented at a 90 degree angle. "Spaced-apart," in this specification, is defined as separated by distance and not touching. In some embodiments, the vertical straps are longer than the horizontal straps. In other embodiments, the ends of the vertical straps are connectorless or, in other words, have flat ends without elements designed for attachment to another part.

Each horizontal strap may include a single loop in the central region of its longest dimension, through which the vertical straps pass. A "loop" is defined, in this specification, as a curved feature, wherein the ends of the curve may meet to form a closed curved or rounded structure, or the curved portion of the structure measures at least 180 degrees of an arc. In embodiments of the disclosed technology, removably connectable loops may be located at the ends of each horizontal strap. "Removably connectable loops" is defined as a mechanism that can be opened and fixedly closed repeatedly, such that when the mechanism is closed, it forms a loop, as defined in this specification. The vertical and horizontal straps that intersect in a substantially perpendicular orientation form a lattice which, for the purposes of this specification, is synonymous with a grid. For the purposes of this specification, "lattice" and "latticed" are interchangeable.

For the purposes of this specification, "strap" is defined as a length of pliable and durable material, such as a fabric composed of natural or synthetic fibers, such as wool, cotton, polyester or nylon, or a combination of the foregoing. The longer dimension of the strap is substantially longer then the shorter dimension.

In this specification, the longer dimension of the strap is used as the reference, when describing a particular strap. For instance, in the case of a horizontal strap, "horizontal" refers to the longer dimension of the strap. For the purposes of this specification, "vertical" refers to an orientation parallel to the axis through the head and foot of a hospital bed or the head and feet of a human body. "Horizontal," in this specification, refers to an orientation substantially perpendicular to the vertical axis of a hospital bed or human body, as defined herein. The horizontal straps can be comprised of two straps: a longer strap and a shorter strap centered on the larger strap and fixedly attached to the larger strap at each end of the shorter strap, creating a loop through which the vertical straps pass. For the purposes of this specification, "horizontal strap" and "larger horizontal strap" are used interchangeably. Further, in this specification, the term "horizontal strap" includes the shorter horizontal strap. The "end" of a strap, for the purposes of this specification, refers to a terminus region of the longer dimension of the strap. Also, for the purposes of this specification, "at least two vertical, spaced-apart, parallel straps" and "vertical straps" are used interchangeably.

In this specification, "corresponding right and left hospital bed rails" refers to the bed rail that is closest to an end of a horizontal strap, when the strap is laid in a substantially horizontal orientation, with its ends as far apart as possible.

In further embodiments of the disclosed technology, the length of said vertical straps is greater than the length of said horizontal straps. In other embodiments, a removable connecting mechanism is located at the ends of the horizontal straps. The connecting mechanism may be closed forming a loop, wherein the loop may enclose a bed rail fixedly attaching the horizontal strap to the rail. The connecting mechanism may be a hook and loop fastener (known commonly as "velcro"); a snap, which may be a hollow circular piece and a raised circular piece that fits into the hollow piece, frictionally holding the pieces together; or any other suitable connector that can fixedly attach the straps to a bed rail. In this specification, "hook and loop fastener" is defined as a connecting mechanism comprising two components. A first component has a plurality of firm, but flexible, projections that are fixed in a substrate on one end. The other end terminates in a curve with an arc measuring at least 180 degrees. The second component contains a plurality of loops that are fixed to a substrate on one end. The ends of the projections on the first component engage the loops of the second component, removably connecting the two components.

In other embodiments, the horizontal straps are rotatable with respect to the vertical straps, passing such that the angle between a horizontal strap and vertical straps is an acute angle. In some embodiments, at least one horizontal strap is rotated at least 10 degrees, and no greater than 60 degrees, from perpendicular to the vertical straps or, in other words, the acute angle formed by the intersection of the rotated horizontal strap and the vertical straps is between 80 degrees and 30 degrees. "Intersection," in this specification, is defined as the junction or point at which two objects meet or cross. "Intersection" and "intersecting" are used synonymously herein. In this specification, "rotatable" is defined as the ability to pivot or turn. For the purposes of this specification, "removable connecting mechanism," "connecting mechanism," "fastener," "end connector," "horizontal connector," and "connector," may be used interchangeably. In this specification an "end" of a horizontal strap may be used interchangeably with a "loop" formed by the closure of the connector at the terminus region of the horizontal strap. For the purposes of this specification "end" and "terminus" may be used interchangeably. The "end" of a strap, in this specification, refers to the terminus region of the longer dimension of a strap.

In embodiments of the disclosed technology, a person may be positioned on the device, after it has been inserted beneath the person. Each horizontal strap can be attached to a bed rail, and each vertical strap can be attached to an end of a bed and secured in place, if desired.

In further embodiments, the vertical straps can be substantially any length from half that of the patient, to the length of the patient, to 1.5 times the length of the patient and/or bed. The horizontal straps can also be of different lengths, with a minimum length being that needed to attach each end to a bed rail with a patient there-between, and a maximum length requiring that a patient is turned to a side when one side of the strap is attached at a location of the other side of the strap. Hook and loop fastening material is also shown in the dotted rectangles at each end of each horizontal strap.

Also disclosed is a kit that may include a latticed patient hoisting device and a hospital bed; a plurality of generally parallel horizontal straps with connectors at each end of the horizontal trap; a plurality of vertical straps passing through a loop at a center region of each of the horizontal straps; bed rails extending along a vertical length of a hospital bed, with a connector at the end of each horizontal strap attached to at least one bed rail on a single side of said bed. In another embodiment of the kit, at least one of the horizontal straps is wrapped around a patient between the end connectors, and the ends of at least one of the horizontal straps are attached to one or two bed rails located on a single side of the hospital bed. Also disclosed is a kit, wherein the end connectors are attached in like kind order at one end to a first bed rail and at another end to a second bed rail; both first and second bed rails are on the same side of the hospital bed. In another embodiment of the kit, the end connectors of the horizontal straps are attached in a different order at the first and second bed rails located on the same side of the hospital bed. Further disclosed is a kit, wherein at least two of the plurality of the horizontal straps pass over each other. In a further embodiment, the kit includes at least two of a plurality of horizontal straps that are oriented at an acute angle with respect to the vertical straps. "Acute angle." for the purposes of this specification, is defined as an angle that measures greater than 0 degrees and less than 90 degrees.

Also disclosed is a method of using a latticed patient-hoisting device that can include the steps of placing a patient on a plurality of vertical straps and a plurality of said horizontal straps; attaching a first end of each of the horizontal straps, by way of a connector, to a first bed rail; with a patient on the plurality of vertical straps, attaching the second end of each horizontal strap to the first bed rail or a second bed rail on the same side of the bed as the first bed rail. In another embodiment, the disclosed method includes the step of performing patient care.

A further embodiment of the disclosed method includes the additional step of adjusting a horizontal strap by angling the strap relative to the other straps until a desired part of the patient body is accessible. For example, horizontal straps can be angled with reference to the vertical straps. This allows access to different areas of the patient, while still holding the patient in a turned position, with the horizontal straps attached to bed rails on either side.

Another embodiment of the disclosed method adds the step of attaching the first end of horizontal straps to a first bed rail in a first order, and attaching the second end of the horizontal straps to the first bed rail, or a second bed rail on the same side of the bed as the first bed rail, in a different order.

In an embodiment of the disclosed method, the horizontal straps can be pulled upwards and towards the bed rail, simultaneously turning the patient (who may have turned partially, fully, or not at all by means of his/her own ability to turn). In this manner, the horizontal straps are attached to the bed rail on the same side, with vertical straps giving back support and keeping the horizontal straps fully or substantially aligned; or, at least, connected together by way of the vertical straps. The horizontal straps can further be angled by moving one connector of the strap up or down the bed rail, to allow access to a specific spot on the patient or avoid contact with such a specific spot. During cleansing of the patient, movement of the straps allows the patient to be held in a turned position, while still allowing access to the entire surface of the patient by the movement of a strap to cover a particular spot, while the patient is supported by other straps.

In a further embodiment, the disclosed method includes the step of placing a patient parallel to the vertical straps, wherein the patient's horizontal mid-point is approximately centered between the vertical, such that the middle horizontal strap runs approximately through the vertical center of the patient's body. In an additional embodiment, the disclosed method includes a further step of looping the ends of the horizontal straps around the corresponding right and left hospital bed rails and fastening with connectors.

In yet another embodiment, the disclosed method includes the step wherein the horizontal straps are oriented substantially perpendicular to the axis along the head and foot of the bed.

DETAILED DESCRIPTION OF EMBODIMENTS OF THE DISCLOSED TECHNOLOGY

The latticed patient-hoisting device assists in maneuvering and holding in position a patient lying in a hospital bed having rails, the latticed hoisting device having a lattice of cross-wise material (horizontal and vertical) with a vertical length greater than, or equal to, that of the torso length of the patient. The cross-wise material can be comprised of rectangular straps. For the purposes of this specification, "vertical" refers to an orientation along the axis through the head and foot of a hospital bed or the head and feet of a human body. "Horizontal," in this specification, refers to an orientation along the axis through the sides of a hospital bed or sides of a human body, and substantially at a 90 degree angle to the vertical axis. The horizontal straps can be comprised of two straps, namely a longer strap and a shorter strap centered on the larger strap and fixedly attached to the larger strap at each end of the shorter strap. The width and lattice portion thereof is sufficiently long so as to encompass a person's torso or entire body from neck to feet. The horizontal lengths of the latticed patient-hoisting device have connecting mechanisms at each end which attach to a bed rail.

Embodiments of the disclosed technology will become clearer in view of the following discussions of the figures.

Figure 1:
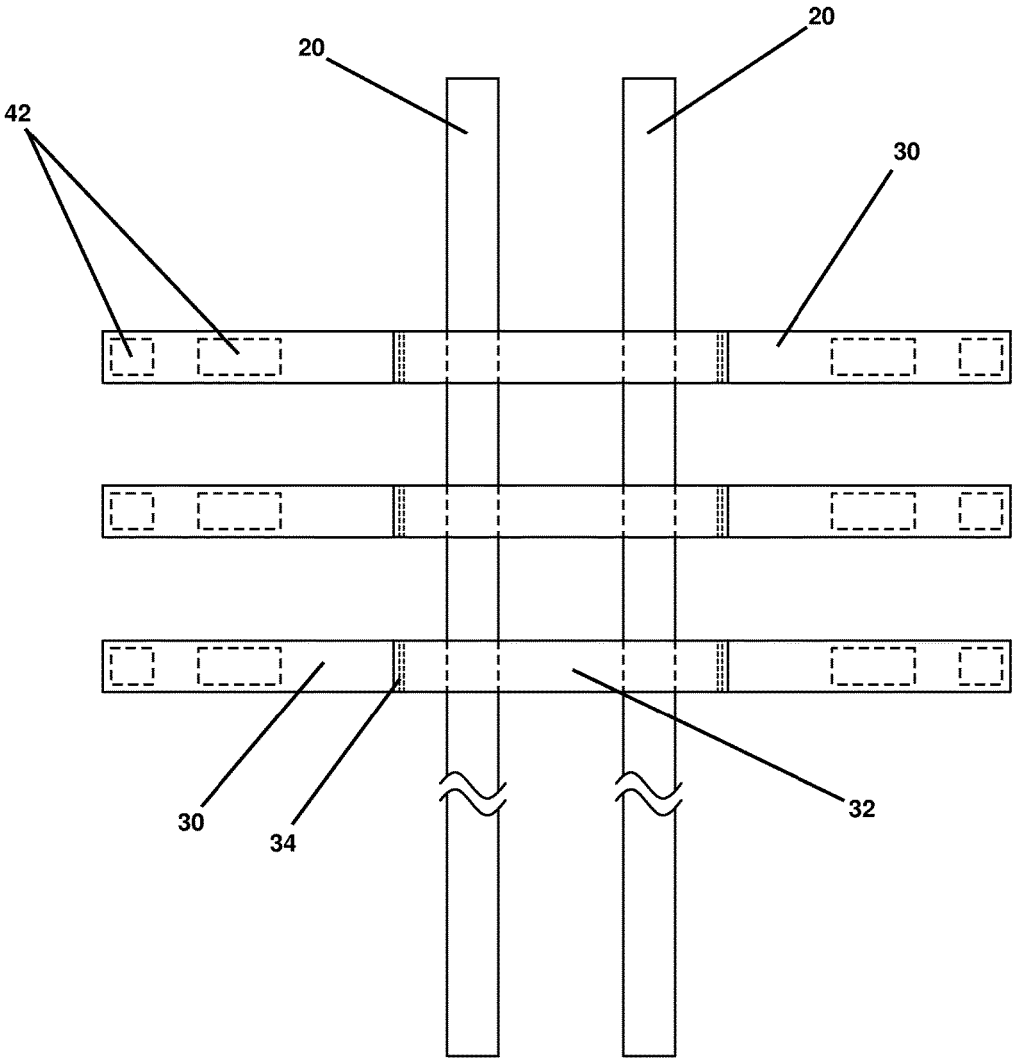
FIG. 1 shows a bottom view of the latticed patient-hoisting device.

FIG. 1 shows a bottom view of the latticed patient-hoisting device. The horizontal straps 30 are oriented at a substantially 90 degree angle in relation to the vertical straps 20. A second, shorter, horizontal strap 32 is centered on each of the larger horizontal strap 30 and covers a middle section of the larger horizontal strap 30. The shorter horizontal straps 32 are fixedly attached to the larger horizontal straps 30 at the ends 34 of the shorter strap 32. The connecting mechanisms 42 are located at the ends of the horizontal straps 30.

Figure 2:
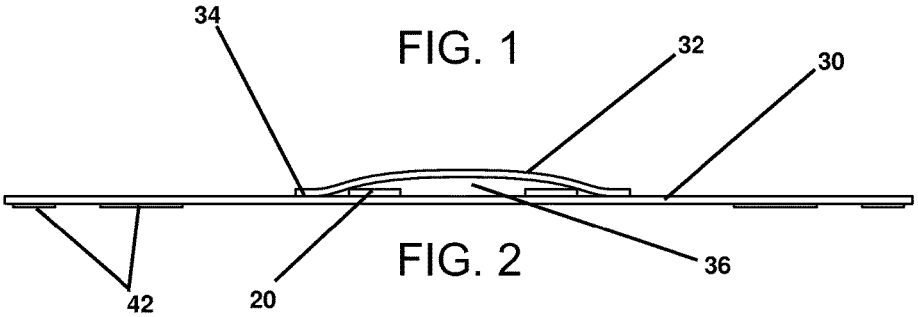
FIG. 2 shows a side elevation view of the latticed patient-hoisting device.

FIG. 2 shows an inverted side elevation view of the latticed patient-hoisting device. The shorter horizontal strap 32 is centered on the larger horizontal strap 30 and fixedly attached to the larger horizontal strap 30 at its ends 34. The connection between shorter horizontal strap 32 and the larger horizontal strap 30 forms a loop 36 through which the vertical straps 20 pass. At each end of the horizontal straps 20 a connecting mechanism 42 is located.

Since each vertical and horizontal strap length of material which forms a vertical or horizontal length is separate, each can be individually placed under the patient and latticed together during placement. Each strap has a plurality of portals for entry of other straps, with a width substantially wider than the strap to be inserted. A portal can be wide enough to position two straps spaced apart from one another, such as at either side of a torso. Since the portals are wider than the straps, the straps can be moved slightly as needed, by angling a vertical strap relative to a horizontal strap, or a horizontal strap relative to vertical strap. In this manner, any particular spot on the person can be accessed for cleansing, surgical procedures, or the like. Further, a particular spot can be avoided, such as an area of a bruise, inserted needle, burn, painful area, broken rib, or the like. In this manner, the person can be turned with this device without causing harm.

Figure 3:
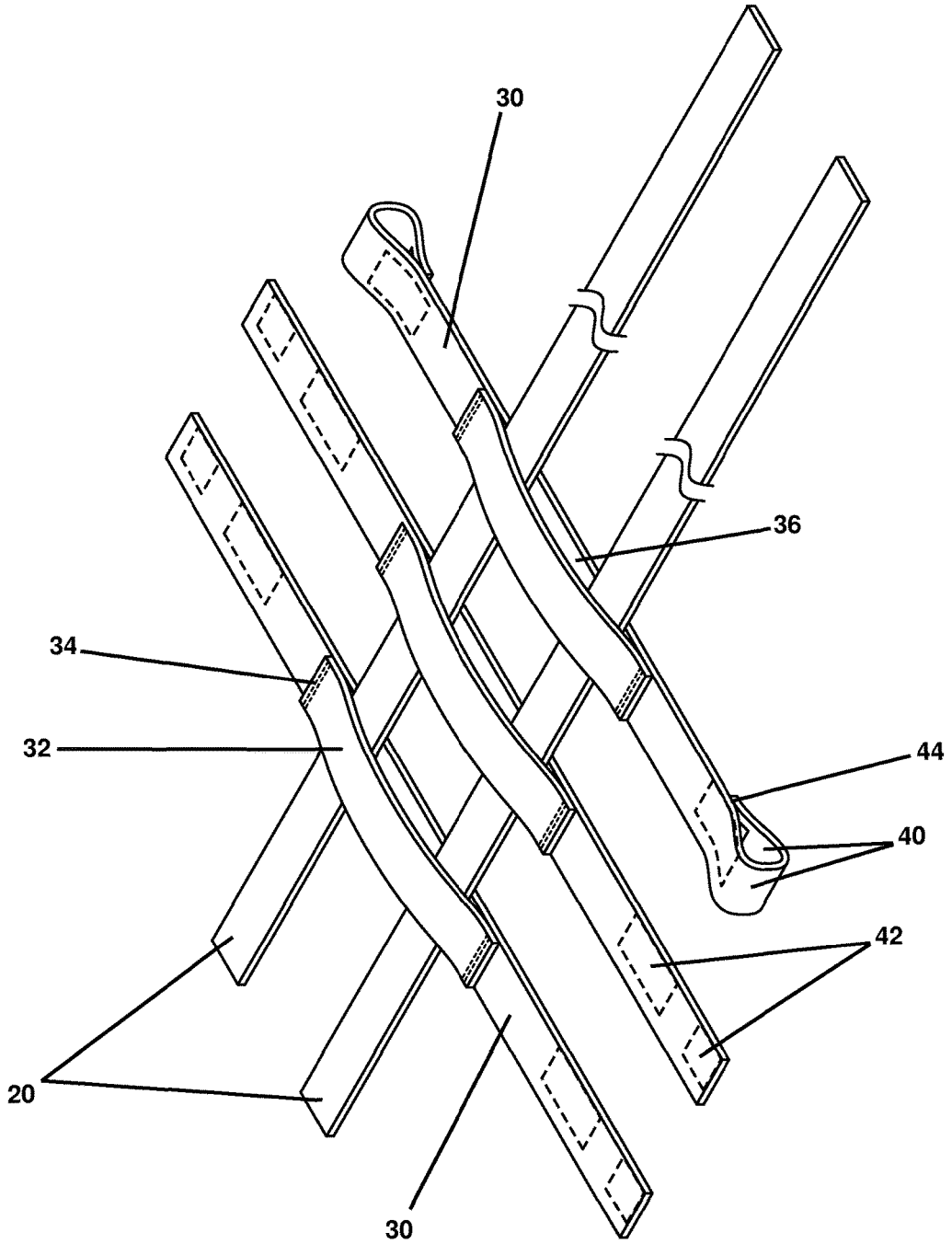
FIG. 3 shows a bottom perspective view of the latticed patient-hoisting device.

FIG. 3 shows a bottom perspective view of the latticed patient-hoisting device. The vertical straps 20 pass through the loops 36 created by the connection between the shorter horizontal straps 32 and the larger horizontal straps 30. The connecting mechanism 42 at the ends of the horizontal straps 30 may be closed at a connection point 44, thus forming a loop 40 at the end of the horizontal strap 30.

Figure 4:
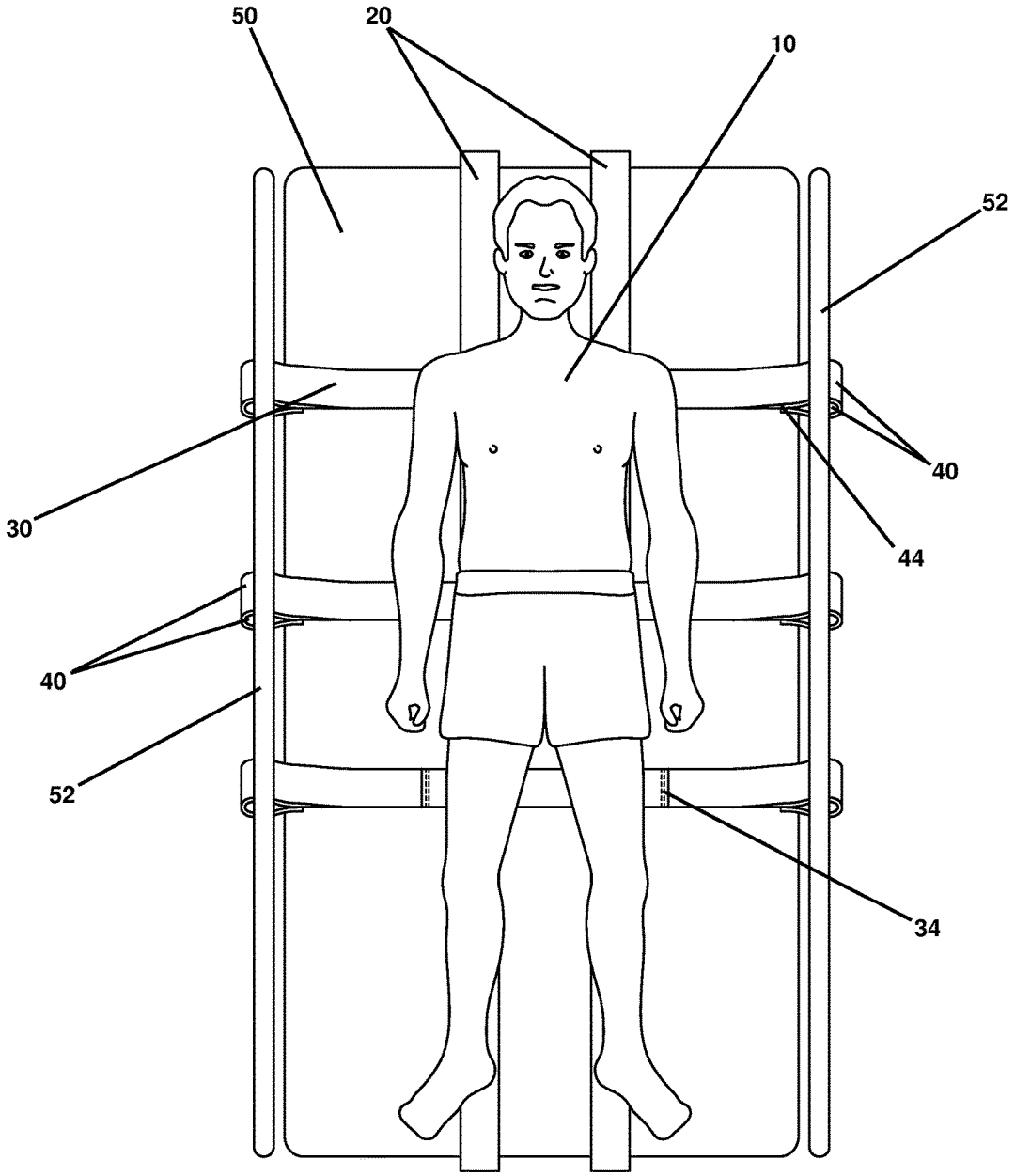
FIG. 4 shows a top view of the latticed patient-hoisting device attached to a hospital bed, with patient lying on it.

FIG. 4 shows a top view of the latticed patient-hoisting device attached to a hospital bed, with patient lying on it. The latticed patient-hoisting device is placed on a hospital bed 50 equipped with rails 52. The hospital bed may be equipped with one or more rails on each side. Returning to FIG. 4, a patient 10 is placed on the latticed patient-hoisting device in a manner in which the patient 10 is parallel to the vertical straps 20. The connecting mechanisms 42 create a loop 40, at the ends of the horizontal straps 30, around the bed rails 52.

Figure 5:
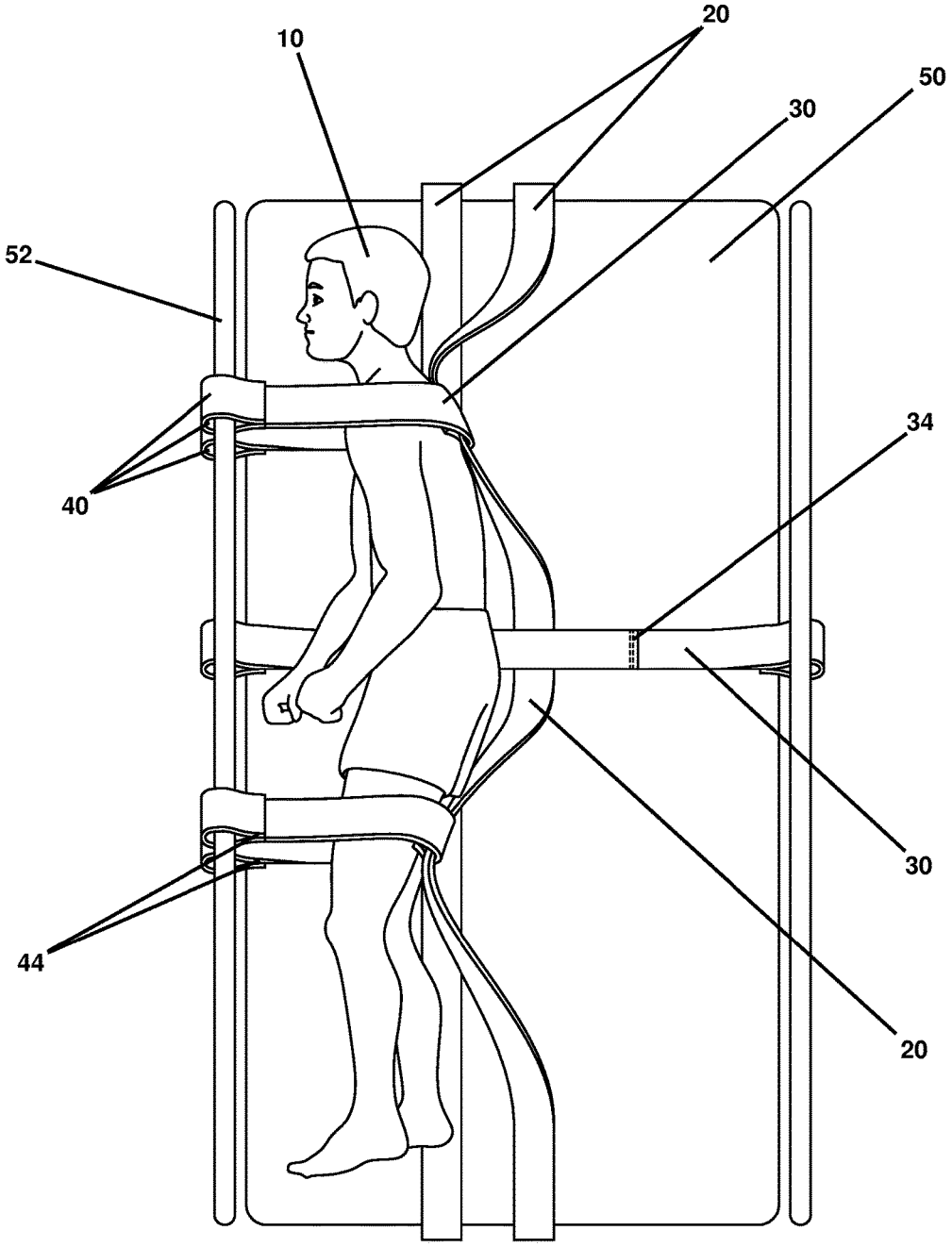
FIG. 5 shows a top view of the latticed patient-hoisting-device in use, with some horizontal straps attached to same of a hospital bed.

FIG. 5 shows a top view of the latticed patient-hoisting device in use, with some horizontal straps attached to the same rail of a hospital bed. Horizontal straps 30 may be attached to the same bed rail 52 or rails on the same side of a hospital bed 50, by forming a connection 44, using the connecting mechanism 42 at the end of the horizontal straps 30, and wrapping the resulting loop 40 around a bed rail 52. The patient 10 is moved and held in a turned position by connecting the ends of the horizontal straps 30, with loops 40 formed by closing the connecting mechanism 42. Note also that the torso of the patient is centered, or substantially centered, on the length of straps, meaning that the patient is equidistant from both connectors of at least one horizontal strap and equidistant from extreme ends of at least one vertical strap.

Figure 6:
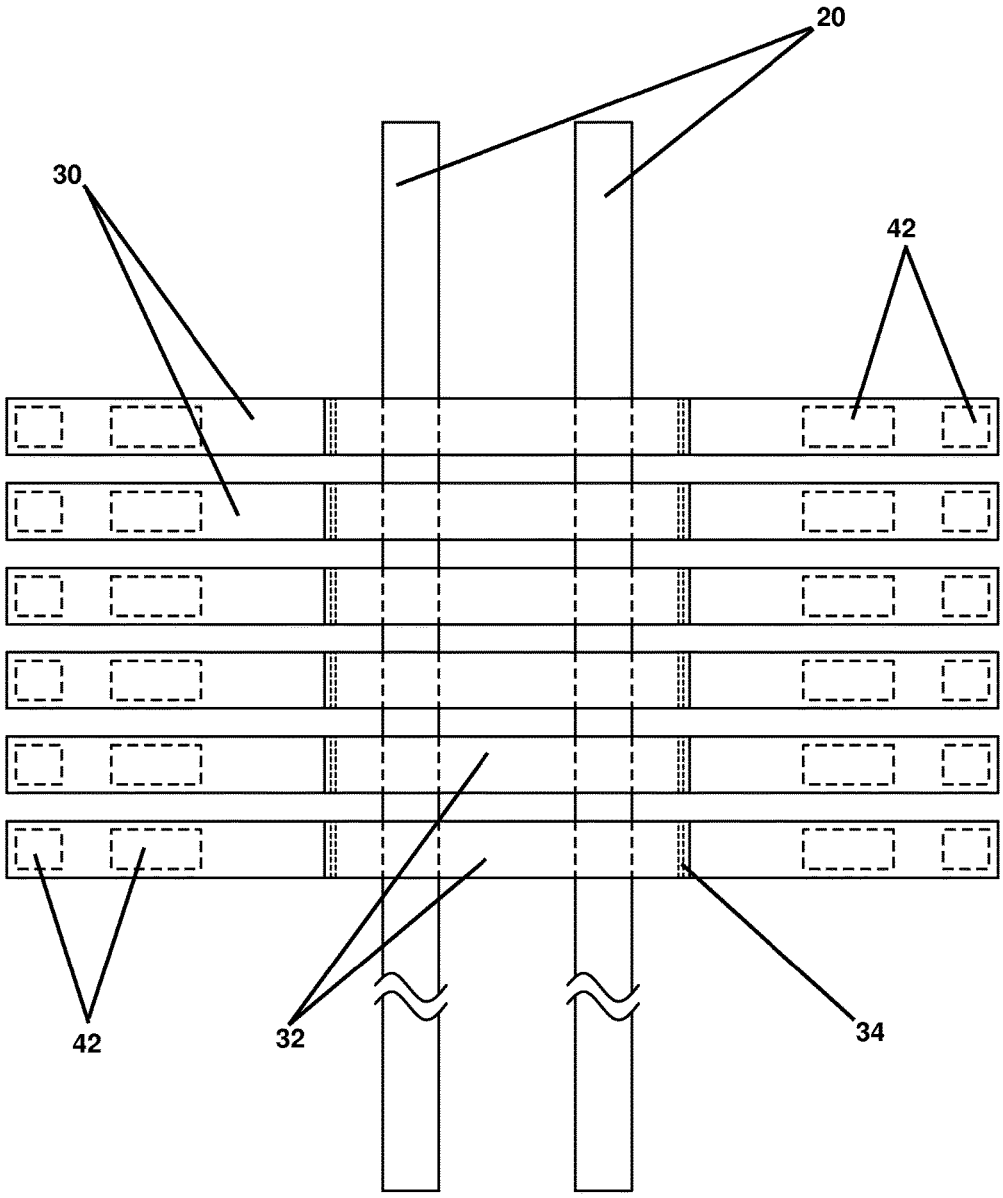
FIG. 6 shows a bottom view of the latticed patient hoisting-device containing 6 horizontal straps.

FIG. 6 shows a bottom view of the latticed patient-hoisting device containing 6 horizontal straps. The horizontal straps 30 are oriented at a substantially 90 degree angle in relation to the vertical straps 20. A second, shorter, horizontal strap 32 is centered on each of the larger horizontal straps 30 and covers a middle section of the larger horizontal strap 30. The shorter horizontal straps 32 are fixedly attached to the larger horizontal strap 30 at the ends 34 of the shorter strap 32. The connecting mechanisms 42 are located at the ends of the horizontal strap 30.

Figure 7:
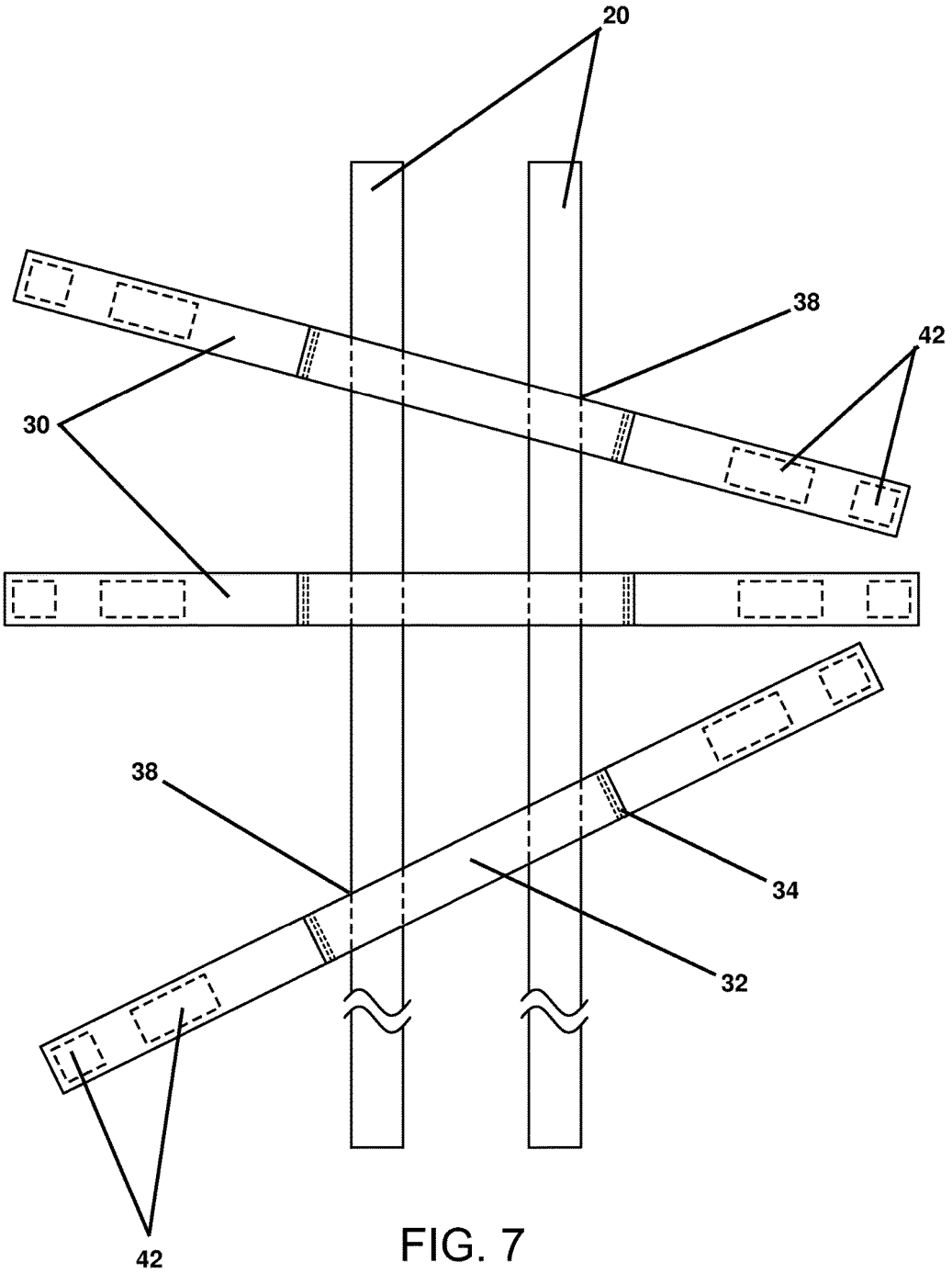
FIG. 7 shows a bottom view of the latticed patient-hoisting device, with 2 horizontal straps positioned at an acute angle in relation to the vertical straps.

FIG. 7 shows a bottom view of the latticed patient-hoisting device with two horizontal straps positioned at other than a 90 degree angle in relation to the vertical straps. The loops 36 formed by the connection between the longer horizontal strap 30 and shorter horizontal strap 32 contain sufficient room for the horizontal straps 30 to be oriented at an angle other than a 90 degree angle 38 in relation to the vertical straps 20.

Figure 8:
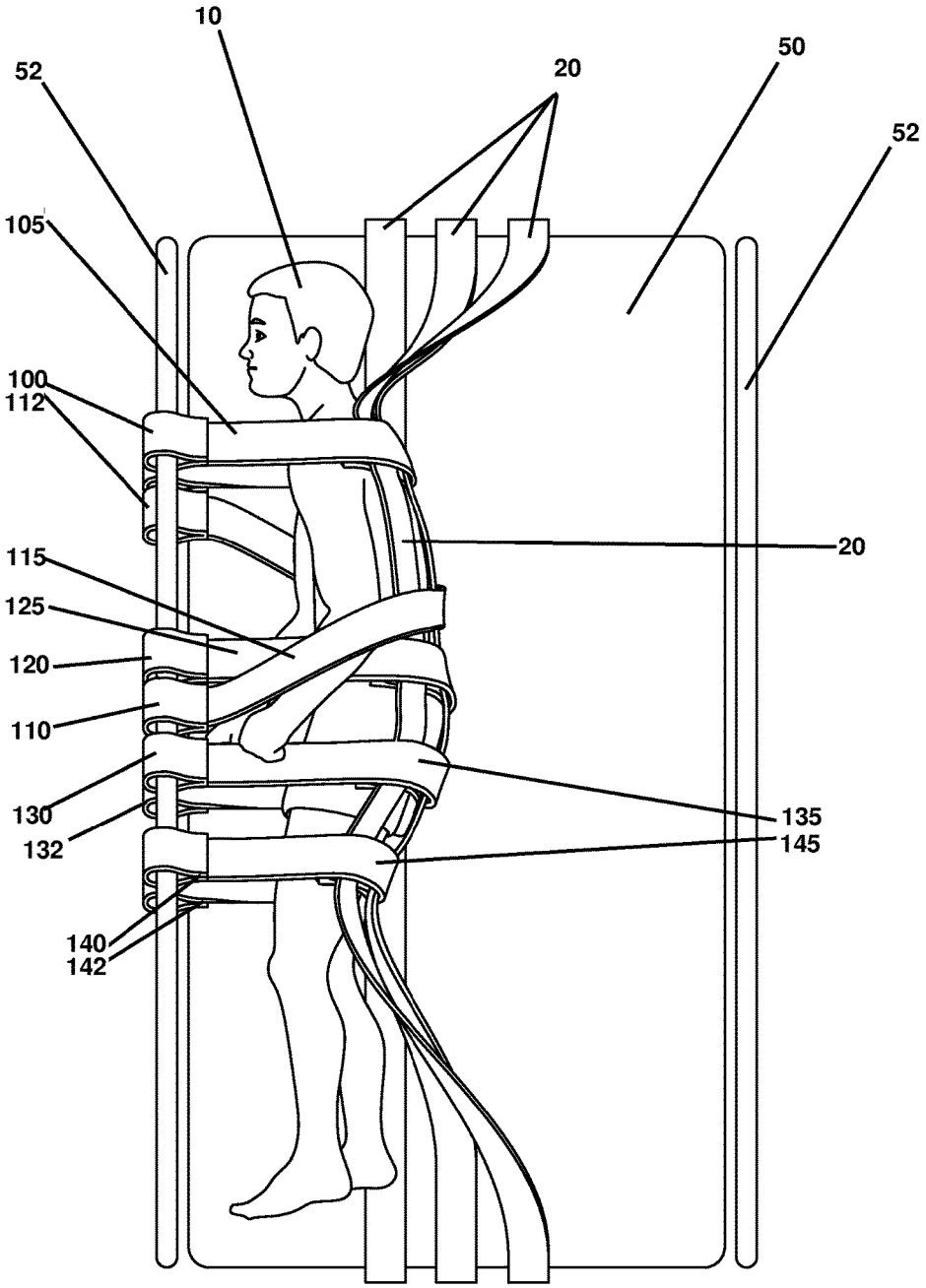
FIG. 8 shows a top view of the latticed patient-hoisting device in use, with all horizontal straps attached to the same rail of a hospital bed and one strap with its ends spaced apart in relation to their vertical positions on the bed rail.

FIG. 8 shows a top view of the latticed patient-hoisting device in use, with all horizontal straps attached to the same rail of a hospital bed, and one strap with its ends spaced apart in relation to their vertical positions on the bed rail. The vertical straps 20, bed 50, and upper bed rail 52 remain as described with reference to the previous figures. Here, five horizontal straps are shown. The first strap has connectors 100 (top bed rail) and another to a bottom bed rail. Each subsequent strap has two end connectors, though only one connector may be visible, such as connector 110 of the second strap, 120 of the third strap, 130 (top bed rail connection) and 132 (bottom bed rail). Finally, a strap with connector 140 and 142 is at the bottom. Each strap is similarly numbered consecutively, in order 105, 115, 125, 135, and 145. Here, it should be noted that the order of connection to one bed rail is different from the order of connection to the other bed rail. Strap 115 passes over strap 125 at an acute angle to strap 125. This acute angle can be any reasonable amount such as 5 degrees, 15 degrees, 30 degrees, 45 degrees, 60 degrees or any angle less than 60 degrees. As shown, the strap 115 has its connector 112 "in order," while the connector on the other end, connector 110, is "out of order" between connectors 120 and 130.

If the strap 115 extends horizontally across, like the other straps, then a portion of the patient's back under the strap would be covered. This can be undesirable when such a portion or location on the back has a wound, needs to be inspected, cleansed, or receive medical treatment. In use, one can continue to move strap connectors, one at a time, from one location to another, with the remaining connectors staying in place. As the plurality of other connectors remains connected, the patient remains held in place, and one can subsequently access the entirety of the patient's body as each strap can be moved.

Figure 9:
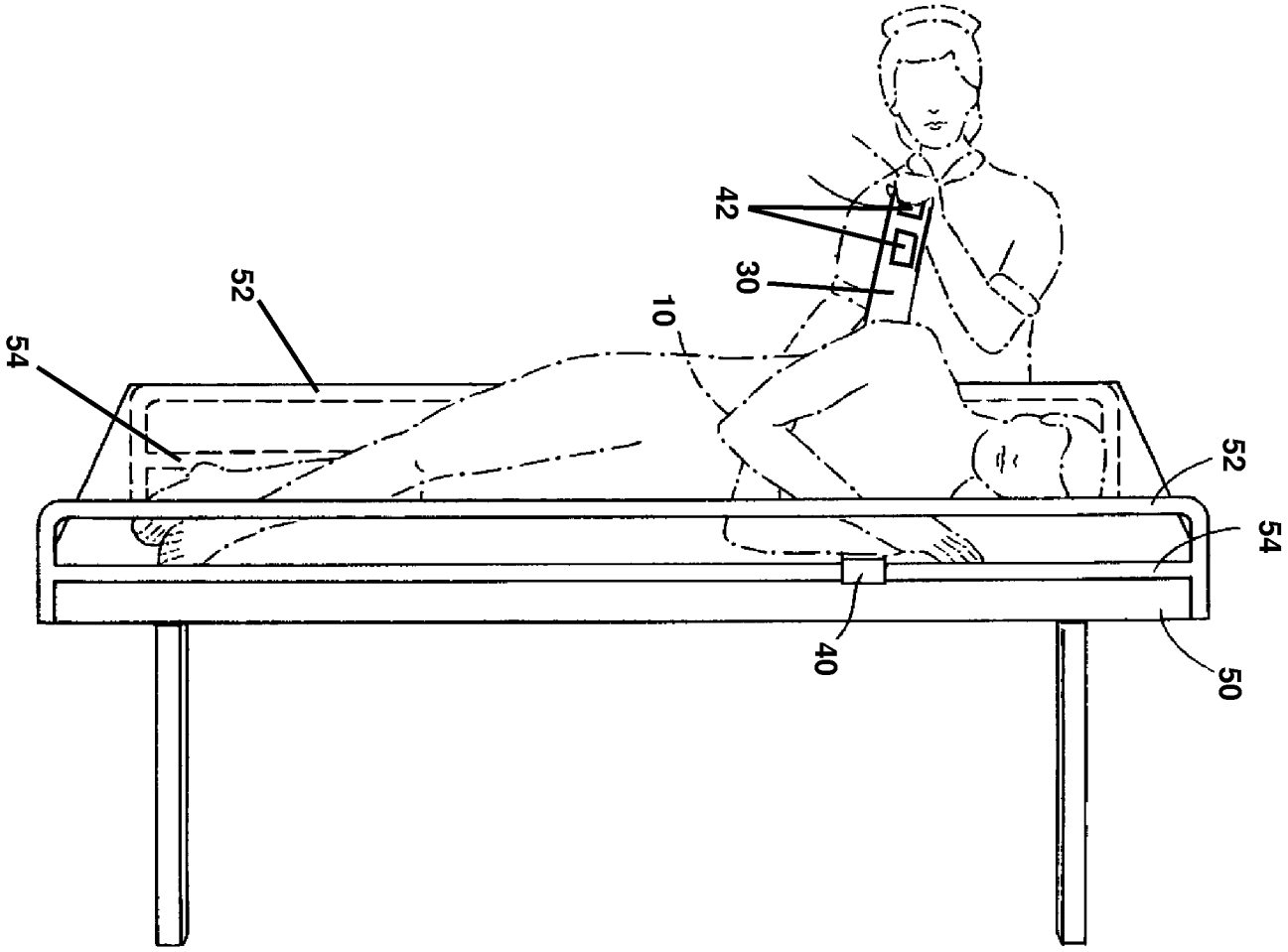
FIG. 9 shows a side perspective view of a patient lying in a double-railed hospital bed with a strap of the latticed patient-hoisting device attached to the bottom rail.

FIG. 9 shows a side perspective view of a patient lying in a double-railed hospital bed, with a strap of the latticed patient-hoisting device attached to the bottom rail. One end 40 of horizontal strap 30 may be attached to a bottom rail 54 of a hospital bed 50, by closing the connector 42 around the bottom rail 54 and forming a loop 40. The other end of the horizontal strap 30 may by drawn over and across the body of the patient 10 and attached to either the top rail 52 or the bottom rail 54 of the hospital bed 50.

Figure 10:
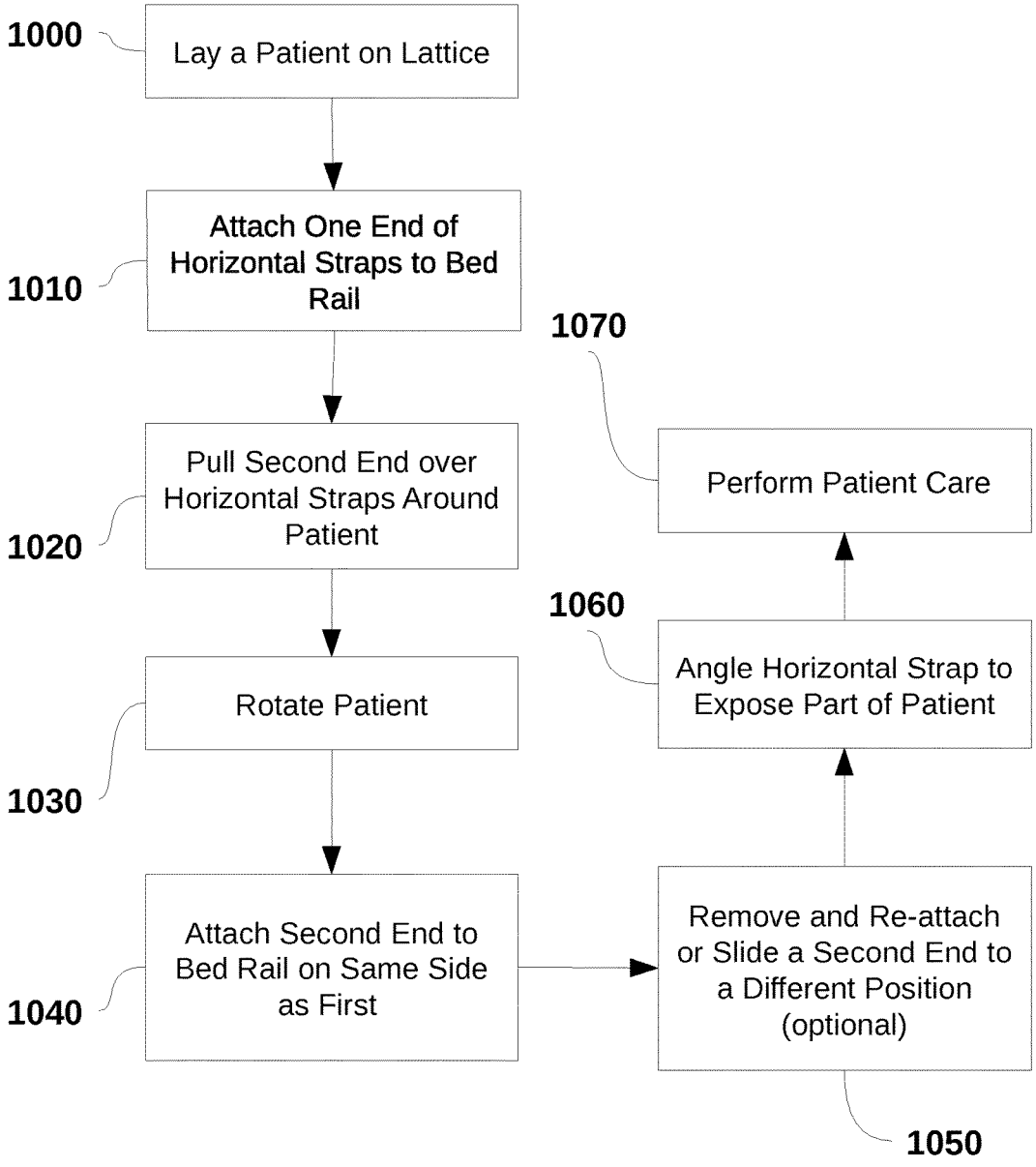
FIG. 10 is a flowchart describing a method for the use of the latticed patient-hoisting device.

FIG. 10 is a flowchart describing a method for the use of the latticed patient-hoisting device. In the first step 1000, a patient is placed on the latticed patient-hoisting device in a hospital bed 50 that is equipped with at least one rail 52 on each side. Next, in step 1010, the ends 40 of a first side of the horizontal straps 30 are attached to a first or second rail 52 of a first side of a hospital bed 50. The ends 40 of a second side of the horizontal straps 30 are then, in step 1020, drawn or pulled across the patient's body 10. In step 1030, the pressure exerted on the horizontal straps 30 is used to turn the patient to the desired position. Thereafter, in step 1040, the ends 40 of the second side of the horizontal straps 30 are attached to the first or second rails 52/54 of the first side of the hospital bed. Then, in step 1050, an end 40 of one or more horizontal straps 30 may be repositioned on the first or second rails 52/54 of a first side of a hospital bed 50. In step 1060, the repositioned one or more horizontal straps 30 provide access to the desired region of the patient's body 10. Patient care or the administration of treatment may then be performed in step 1070.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

"Substantially" and "substantially shown," for purposes of this specification, are defined as "at least 90%," or as otherwise indicated. When referring to angles in this specification, "substantially" is defined as no greater than 15 degrees. Any device may "comprise" or "consist of" the devices mentioned there-in, as limited by the claims. It should be understood that the use of "and/or" is defined inclusively, such that the term "a and/or b" should be read to include the sets: "a and b," "a or b," "a," "b."

The invention claimed is:

1. A latticed patient-hoisting device for a hospital bed comprising:

at least two vertical parallel straps;

at least three horizontal straps spaced apart from each other and disposed substantially perpendicular to said vertical straps, said at least three horizontal straps including a first horizontal strap, a second horizontal strap, and a third horizontal strap, wherein said first horizontal strap includes a first loop, said second horizontal strap includes a second loop, and said third horizontal strap includes a third loop, and wherein said at least two vertical straps pass through each of the first loop, the second loop, and the third loop at the same time; and removably connectable loops at each end of each horizontal strap, wherein the at least two vertical straps are adjustably disposed such that a distance therebetween is adjustable within each of the first, second, and third loops.

2. The device of claim 1, wherein a length of said vertical straps is greater than that of said horizontal straps and each said vertical strap is unfastened to any of said horizontal straps.

3. The device of claim 1, wherein each of said removably connectable loops comprises both hook portion and a loop portion of a hook and loop fastening mechanism on a length of an end region of a horizontal spaced-apart strap of said at least three horizontal straps, and said removably connectable loop comprises said hook and loop fastening mechanism arranged in a closed state.

4. The device of claim 1, wherein each of said at least two vertical parallel straps are rotatable within each of said first loop, said second loop, and said third loop, at least 10 degrees from perpendicular to said first, second, and third horizontal straps, respectively, while said at least three horizontal straps remain unmoved.

5. The device of claim 1, wherein each of said removably connectable loops at each end of each horizontal strap comprise both a hook and loop fastener.

6. The device of claim 1, wherein each of said first, second, and third horizontal straps extends on either side of each of said first and second vertical straps.

7. The device of claim 1, wherein each of said first, second, and third horizontal straps extends on either side of each of said first, second, and third loops, respectively.

8. The device of claim 1, wherein a length of each of said vertical straps is greater than a sum of a width of each of said first, second, and third horizontal straps, a distance between said first and second horizontal straps, and a distance between said second and third horizontal straps.

9. The device of claim 1, wherein said first, second, and third loops are each formed of a piece of fabric, stitched to each of said first, second, and third horizontal straps, respectively.

10. The device of claim 1, wherein each of said vertical straps has a length approximately equal to a height of a patient.

11. A latticed patient hoisting device for a hospital bed, comprising:

a first horizontal strap comprising a first loop substantially centered thereon;

a second horizontal strap comprising a second loop substantially centered thereon;

a third horizontal strap comprising a third loop substantially centered thereon;

a first vertical strap disposed above said first, second, and third horizontal straps, crossing said first, second, and third horizontal straps at substantially right angles, and passing through each of said first, second, and third loops;

a second vertical strap disposed above said first, second, and third horizontal straps, crossing said first, second, and third horizontal straps at substantially right angles, and passing through each of said first, second, and third loops simultaneously with said first vertical strap passing through each of said first, second and third loops, wherein said first and second vertical straps are adjustably disposed such that a distance therebetween is adjustable within each of the first, second, and third loops.

12. The device of claim 11, wherein, during use of said device for hoisting a patient, said first and second vertical straps are arranged in a direction parallel to the patient's spine.

13. The device of claim 11, wherein the first and second vertical straps pass through each of the first, second, and third loops, together, such that said first and second vertical straps are adjustably disposed, and are adapted, during use of said device for hoisting a patient, to meet under the patient's spine in a first state and to rest under each of the patient's shoulders in a second state.

14. The device of claim 11, wherein each of the first, second, and third horizontal straps are adapted, during use of said device for hoisting a patient, to be arranged crosswise on the patient.

15. The device of claim 11, wherein each of said first, second, and third horizontal straps includes a first end loop at one end thereof, and a second end loop at an opposing end thereof, said device further comprising:

a first rail passing through said first end loops of the first, second, and third horizontal straps; and a second rail passing through said second end loops of the first, second, and third horizontal straps.

16. The device of claim 11, wherein a length of each of said vertical straps is greater than a sum of a width of each of said first, second, and third horizontal straps, a distance between said first and second horizontal straps, and a distance between said second and third horizontal straps.

17. The device of claim 11, wherein said first, second, and third loops are each formed of a piece of fabric, stitched to each of said first, second, and third horizontal straps, respectively.

18. The device of claim 11, wherein each of said first and second vertical straps has a length approximately equal to a height of a patient.

* * * * *